United States Patent [19]

Fang

[11] Patent Number: 4,653,787

[45] Date of Patent: Mar. 31, 1987

[54] BACKSET-ADJUSTABLE LATCH OF A CYLINDRICAL LOCK

[75] Inventor: Yao P. Fang, Chiayi, Taiwan

[73] Assignee: Tong Lung Metal Industry Co., Chiayi, Taiwan

[21] Appl. No.: 762,786

[22] Filed: Aug. 6, 1985

[51] Int. Cl.[4] ..... E05C 1/12; E05C 9/00

[52] U.S. Cl. ..... 292/337; 292/169.14

[58] Field of Search ..... 292/337, 1, DIG. 60, 292/169.13, 169.14, 169.18; 70/368

[56] References Cited

U.S. PATENT DOCUMENTS

| | | | |
|---|---|---|---|
| 1,661,454 | 3/1928 | Wilson | 292/337 X |
| 2,058,895 | 10/1936 | Lowe | 70/368 X |
| 2,119,704 | 6/1938 | Denerich | 70/368 X |
| 2,719,744 | 10/1955 | Schlage | 292/1 |
| 2,736,597 | 2/1956 | Russell | 292/337 |
| 3,441,269 | 4/1969 | Doyle | 292/337 X |
| 4,372,594 | 2/1983 | Gater | 292/DIG. 60 X |
| 4,496,178 | 1/1985 | Best et al. | 292/337 X |

*Primary Examiner*—Robert L. Wolfe
*Assistant Examiner*—Russell W. Illich
*Attorney, Agent, or Firm*—Browdy and Neimark

[57] ABSTRACT

The present disclosure relates to a backset-adjustable latch bolt mechanism of a cylinder lock, more particularly to a latch bolt mechanism so mechanically structured that two options of backset of either 2⅜" (60 mm) or 2¾" (70 mm) are alternately available by removing the connecting pin off the retractor slide and pressing down the emerging spot of the fixing button, which is based on a spiral spring, then outwardly pulling the extension case, letting the spot of the case fixing button pop out in the second bore on the extention case so to change the backset of the latch from 2⅜" (60 mm) to 2¾" (70 mm). The latch bolt mechanism is based on a retractor slide having two consecutive latch releasing notches for effecting the mechanical operation.

19 Claims, 28 Drawing Figures

FIG. 15
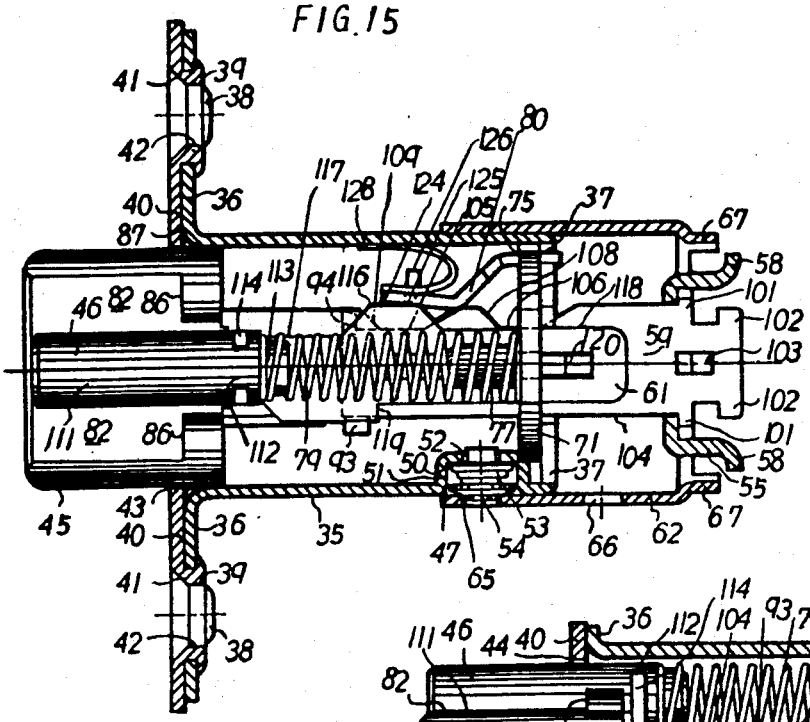
FIG. 16
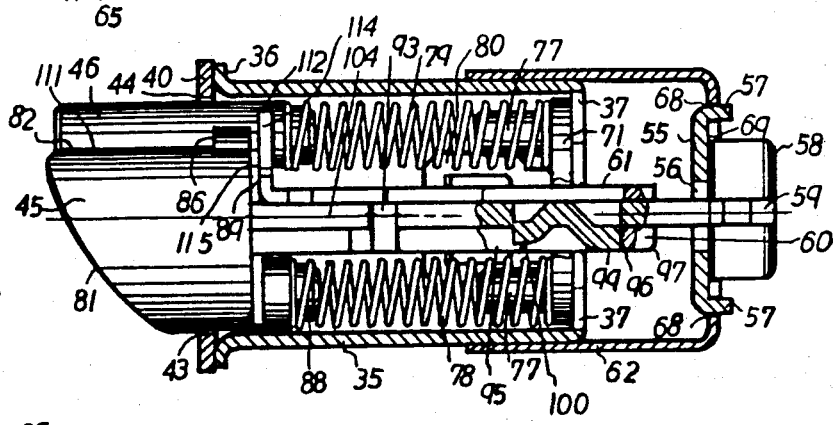
FIG. 17
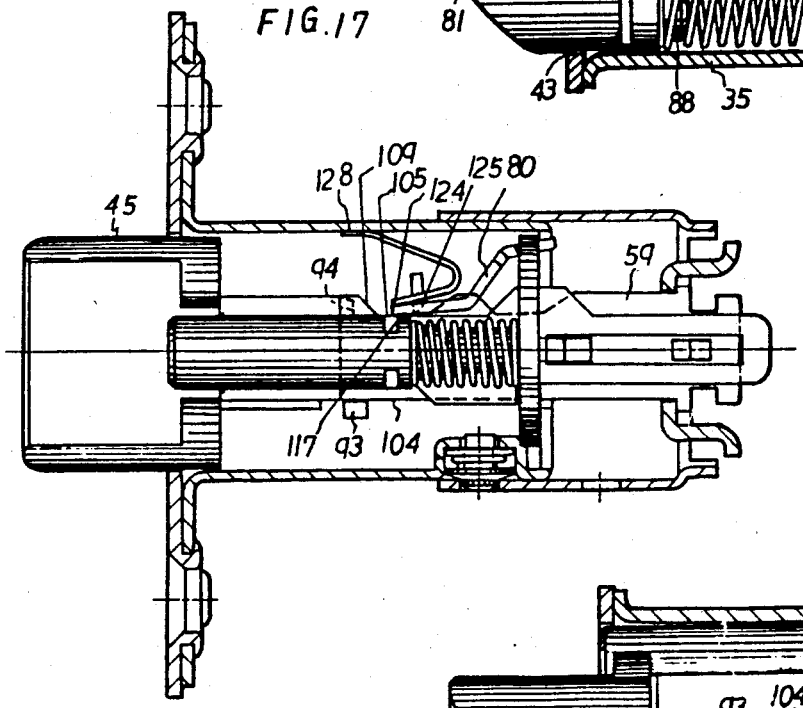
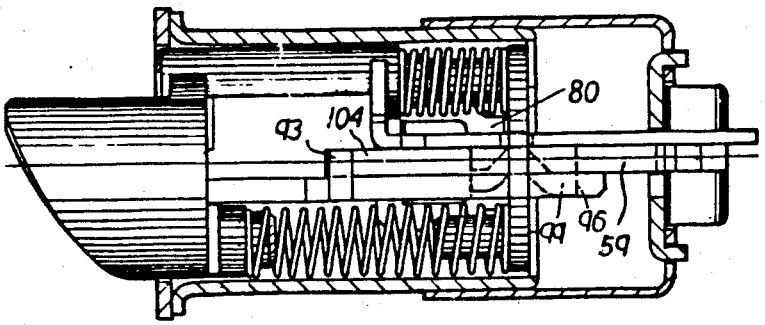
FIG. 18

BACKSET-ADJUSTABLE LATCH OF A CYLINDRICAL LOCK

SUMMARY OF THE INVENTION

Generally speaking, a latch bolt mechanism of a cylinder lock is required to practice the following three major functions:

1. permit the latch bolt to stick out and retract.
2. To guard the latch bolt from being pried open as long as the door is latched.
3. To release the latch bolt and retract it by means of a retractor slide as the door is opened.

The conventional latch bolt mechanism is limited in its application to one size of latch of backset, 2⅜" (60 mm) or 2¾" (70 mm). Mutual exchange between the two sizes is totally impossible.

Most of the consumers of cylinder locks in the international market ignore what type of latch they are purchasing. The lack of the information results in waste of time and money to get the right latch. Manufacturers double their time and equipments to produce two types of latch. Retailers or distributors double their use of storage space to use the exchangeable latch to serve the needs of sizes of latch. In view of the preceding inconvenience the inventor has long devoted his time to experimenting and practicing an improved latch bolt mechanism which will remedy all the disadvantage and inconvenience with the conventional latch bolt mechanism, and finally comes up with a backset-adjustable latch bolt mechanism to serve both types of latch, which saves people from trouble and is very practical to install.

The first object of this invention is to provide an improved latch bolt for cylinder lock which can transform a latch of backset 2⅜" (60 mm) into one of backset 2¾" (70 mm) by simply pressing down a case fixing button on the extension case and pulling out the extension case, or vice versa.

The second object of the invention is to provide a latch bolt mechanism for a cylinder lock which is designed to comply with the required adjustability of backset, and is characterized by its retractor slide having two latch releasing notches instead of one. The leading notch is for relief of the blocked latch bolt of 2¾" (70 mm) backset, and the followed notch is for relief of the blocked latch bolt of 2⅜" (60 mm) backset.

The third object of the invention is to provide a latch bolt mechanism so disposed that the latch bolt extension slide, the guard bolt extension slide and the retractor slide can be releasably joined together by a connecting pin in the case of a latch of backset 2⅜" (60 mm); by removing the connecting pin pulling out the extension case and fixing the case by the case fixing button, the latch can be used as one of backset 2¾" (70 mm).

The fourth object of the invention is to provide a backset-adjustable latch bolt mechanism for a cylinder lock, which particularly has a latch bolt extension slide comprising a guide slot and a slide supporting arm in it. Along the guide slot, the connecting point as well as the balance point of the retractor slide is movable, within its confines, together with the retractor slide, in the longitudinal direction.

With reference to the accompanying drawings, the structure, function, features as well as all the relevant movements of the subject matter will be apparent in the following description.

DETAILED DESCRIPTION OF THE DRAWINGS

The detailed drawings of the subject matter are presented for the purpose of illustration only, and are as set forth below:

Figure 3:
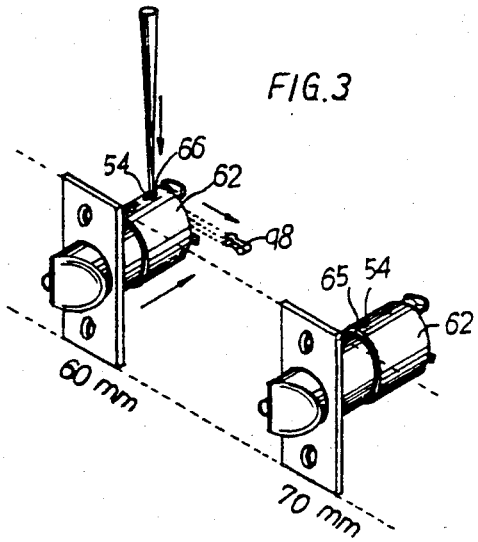

FIG. 3 is a perspective view of the latch bolt mechanism showing a latch of backset 2⅜" (60 mm) being transformed into a latch of backset 2¾" (70 mm) by removing a connecting pin 98 in the indicated direction and then pressing down the case fixing button 54 by any pointed item, and then pulling out the extension case 62 to attain the object.

Figure 4:
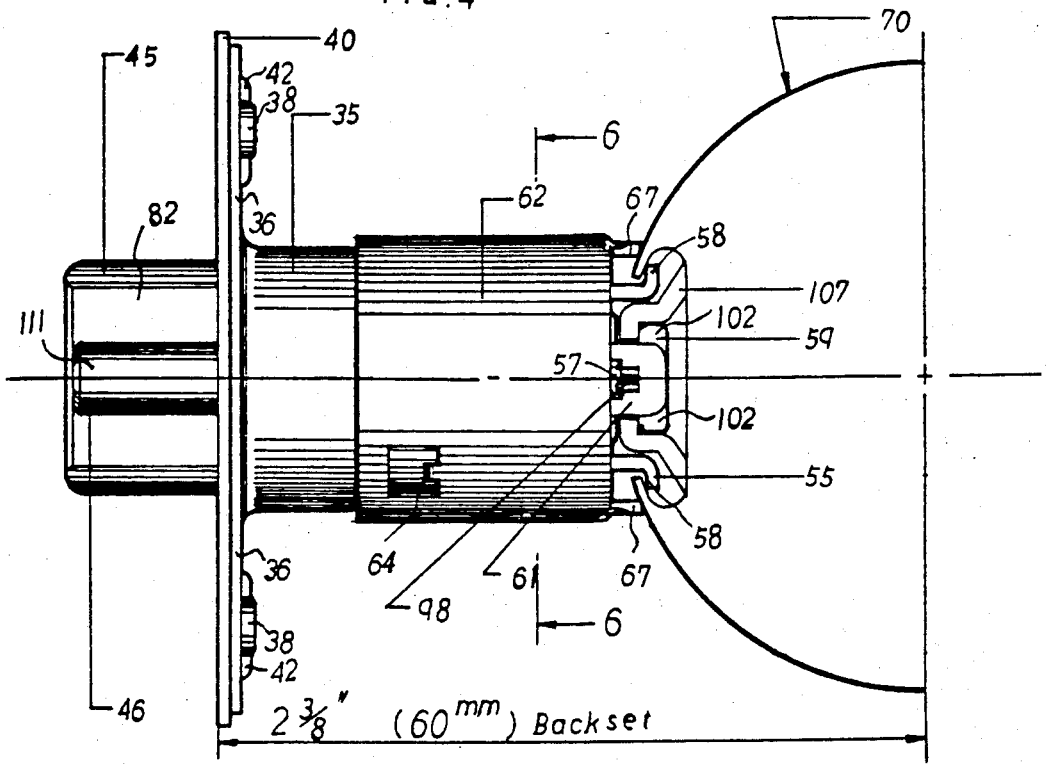

FIG. 4 is a side elevational view of a latch of backset 2⅜" (60 mm), showing the outer part of latch engaging with the retractor 107 and the cylinder case 70.

Figure 5:
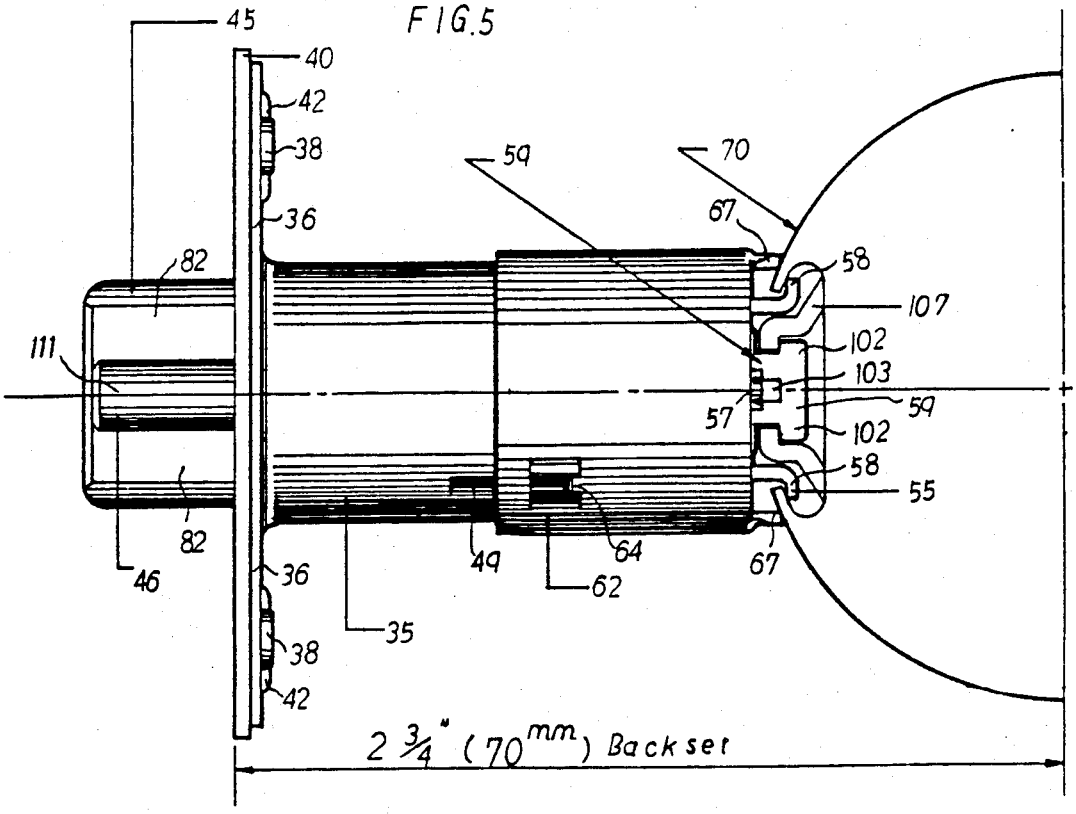

FIG. 5 is a side elevational view of a latch of backset 2¾" (70 mm), showing the outer part of latch engaging with the retractor 107 and the cylinder case 70.

Figure 6:
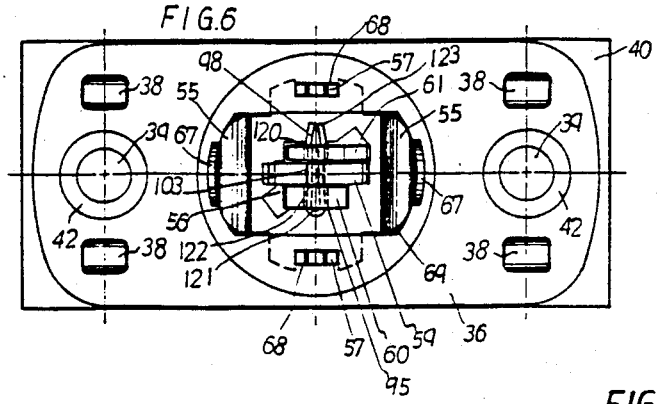

FIG. 6 is a rear view of the latch bolt mechanism in FIG. 4.

Figure 7:
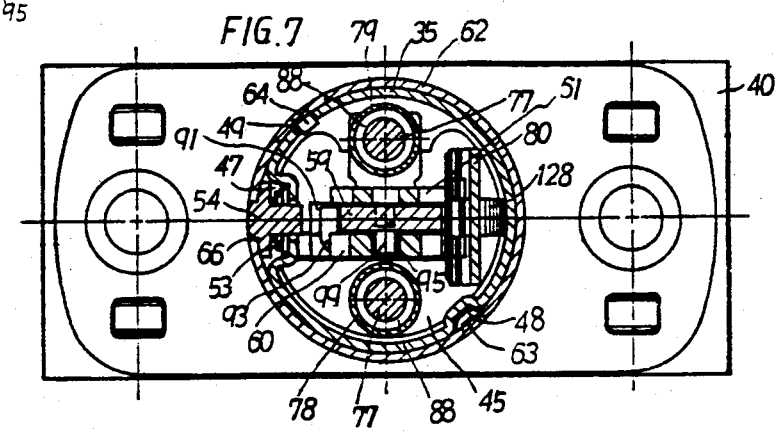

FIG. 7 is a sectional view of the latch bolt mechanism cut by imaginary line 6—6 in FIG. 4.

Figure 8:
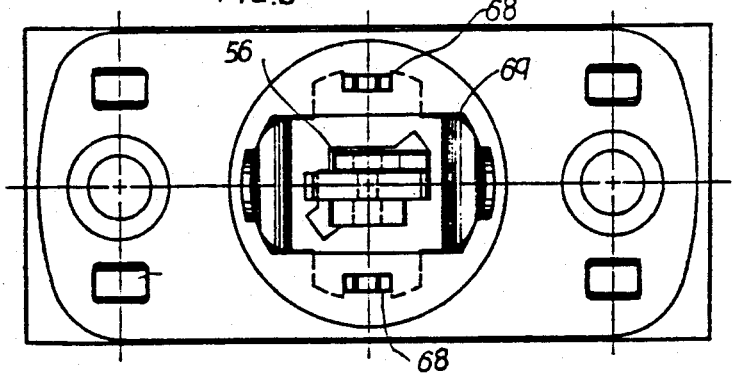

FIG. 8 is a rear view of the latch bolt mechanism without a connecting pin.

Figure 9:
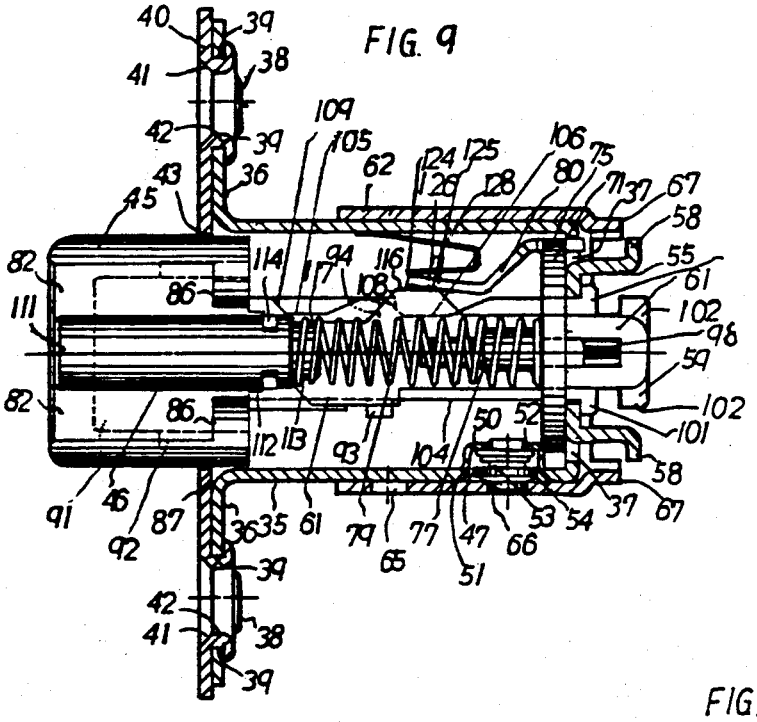

FIG. 9 is a view of the vertically cut latch bolt mechanism in FIG. 4; the cut portions of the face plate 40, latch bolt case 35, extension case 62, latch confining board 55 are removed, revealing the inner structure of the latch of backset 2⅜" (60 mm) in a neutral state, the latch guard bolt as well as the major latch components is in an extended state.

Figure 10:
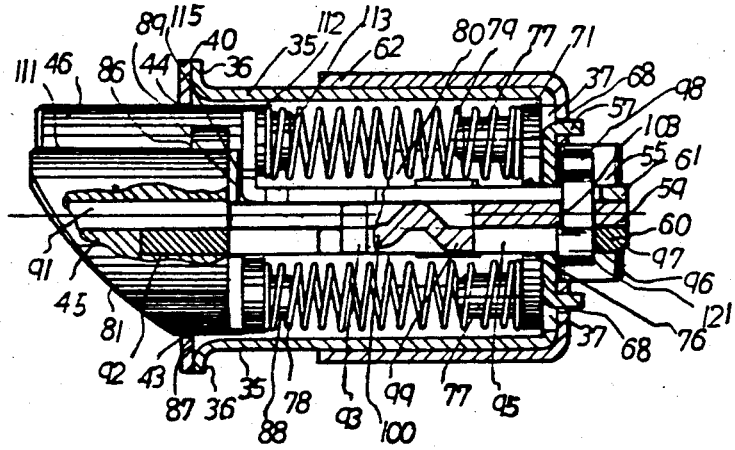

FIG. 10 is a horizontal cross-sectional view of the latch bolt mechanism in FIG. 9; the portions of the face plate 40, the latch bolt case 35, the extension case 62, the latch confining board 55 are removed; the latch bolt 45, the retractor slide 59 and the latch bolt extension slide 60 as well as the latch guard bolt are also partially cutaway in the drawing.

Figure 11:
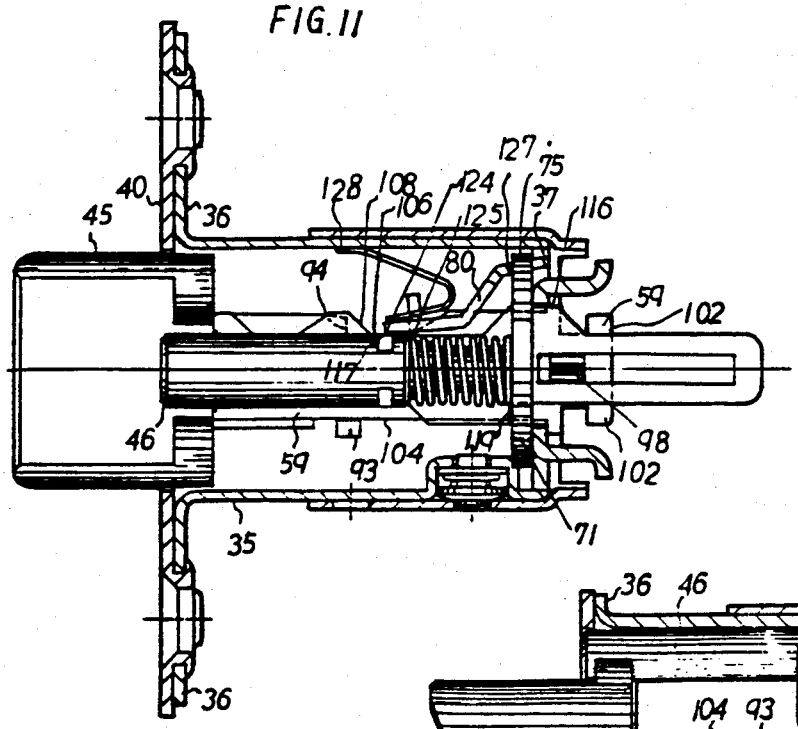

FIG. 11 is a drawing similar to FIG. 9, showing the inner state of the latch bolt mechanism as the door is latched, under which circumstance the latch guard bolt is pushed into the case but the latch bolt remains extended. As a result of the push-in of the guard bolt, the latch bolt stopping plate 80 falls in front of latch bolt the stopping shoulder to block latch bolt from retracting.

Figure 12:
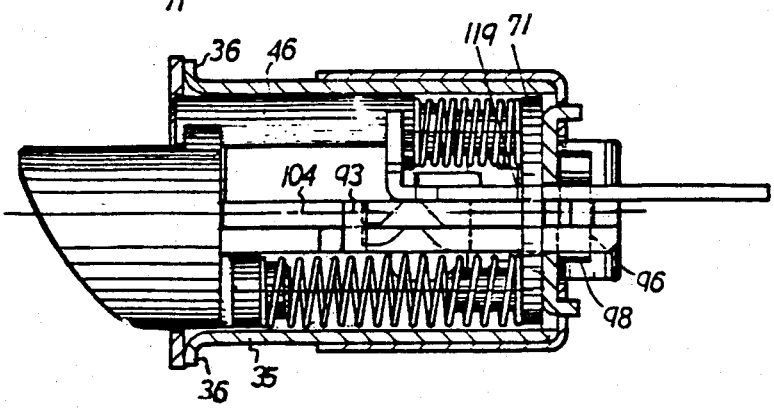

FIG. 12 is a sectional view of the latch bolt mechanism in FIG. 11.

Figure 13:
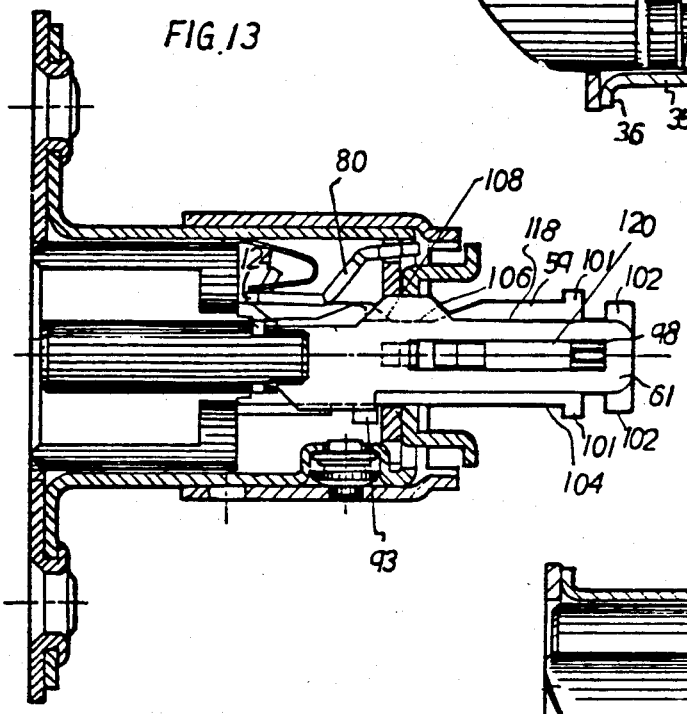

FIG. 13 is a view, resembling FIGS. 9 and 11, showing the retractor engaged with retractor slide 59 which is moved by turning the doorknob to release the latch bolt by lifting up the front side 124 of the latch bolt stopping plate by means of the sloped side plane of the rear latch releasing notch 106, and in the meantime to pull backward the latch bolt mechanism as well as the latch guard bolt mechanism by the connecting pin 98 working on the pin joining wall of the latch bolt extension slide.

Figure 14:
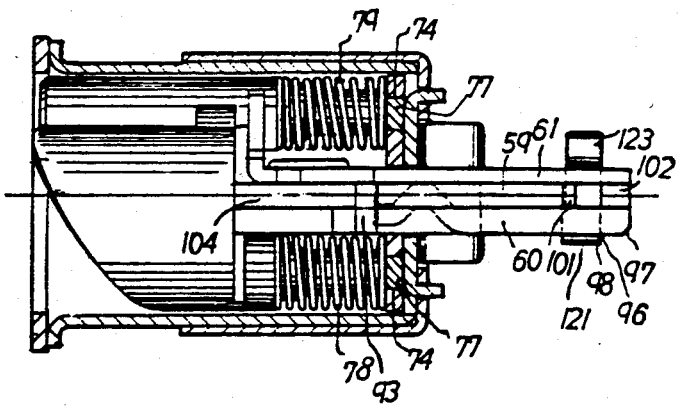

FIG. 14 is a horizontal sectional view of FIG. 13.

FIG. 15 is a vertical cross-sectional view of the latch bolt mechanism in FIG. 5, where half of the face plate 40, the latch bolt case 35, latch confining board 55 have been removed to show the disposition of the latch bolt mechanism as the door is latched.

FIG. 16 is a view of the latch bolt mechanism in FIG. 15, in which part of retractor slide 59, the latch bolt extension slide 60, the guard bolt extension slide 61 and latch base board 71 are removed to show the relevant disposition of connecting point 99, balance point 100 as well as pin joining wall 96.

FIG. 17 resembles FIG. 15 and shows the disposition of latch bolt mechanism when the door is closed; in which the latch bolt stopping plate 80 is in action, so latch bolt 45 cannot be pushed in by force.

FIG. 18 is a horizontal cross-sectional view of the latch bolt mechanism in FIG. 17.

Figure 19:
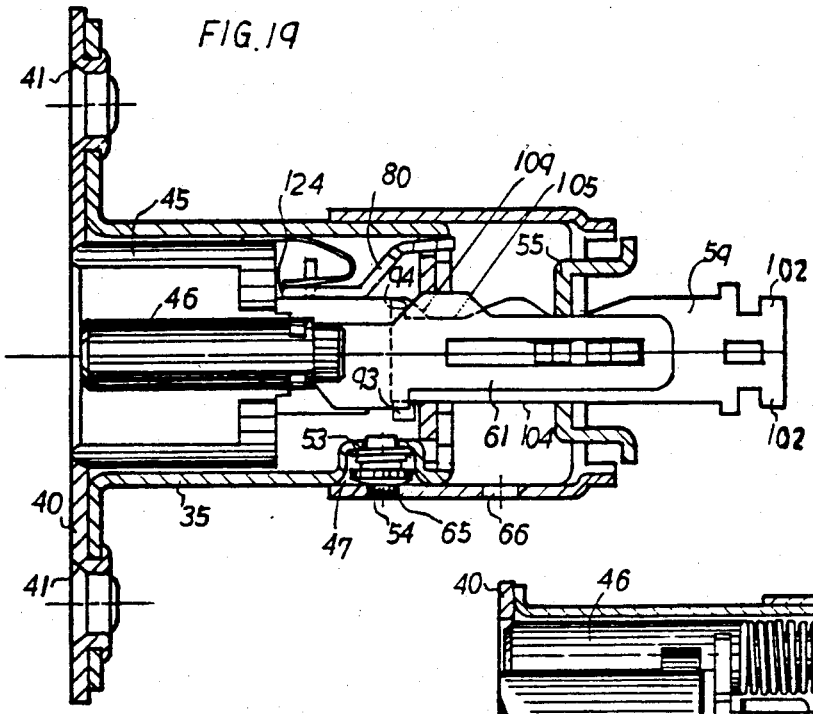

FIG. 19 resembles the views of FIGS. 15 and 17, and shows how doorknob 129 is turned to move retractor 107 so to pull retractor slide 59 backward. As a result of this action, the front latch releasing notch 105 lifts up the front side 124 of latch stopping plate by means of its sloped side plane. In the meantime, connecting point 99, in contact with the pin joining wall, transmit the pulling movement to the latch bolt.

Figure 20:
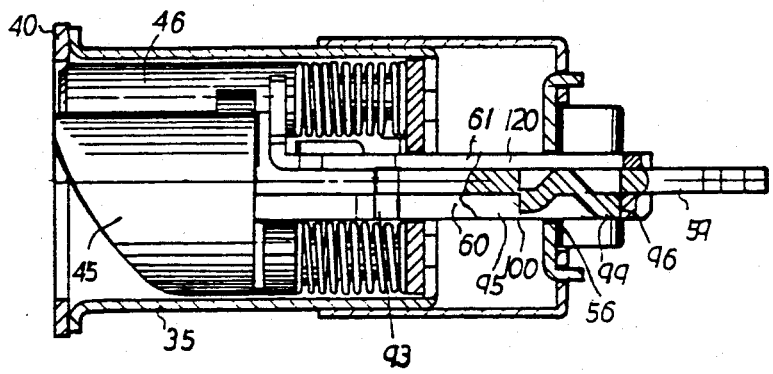

FIG. 20 is a view of the horizontally cut latch bolt mechanism in FIG. 19.

Figure 21:
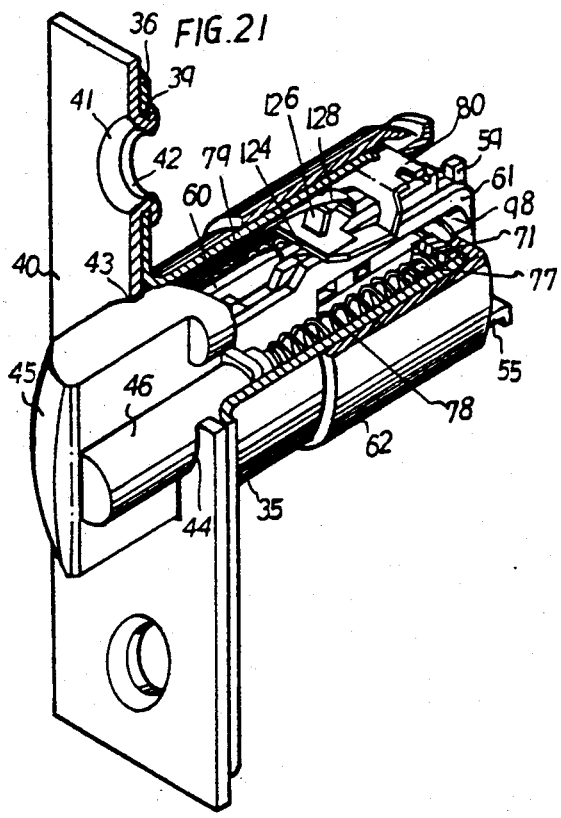

FIG. 21 is a perspective view of a partially exposed latch bolt mechanism of backset 2⅜" (60 mm).

Figure 22:
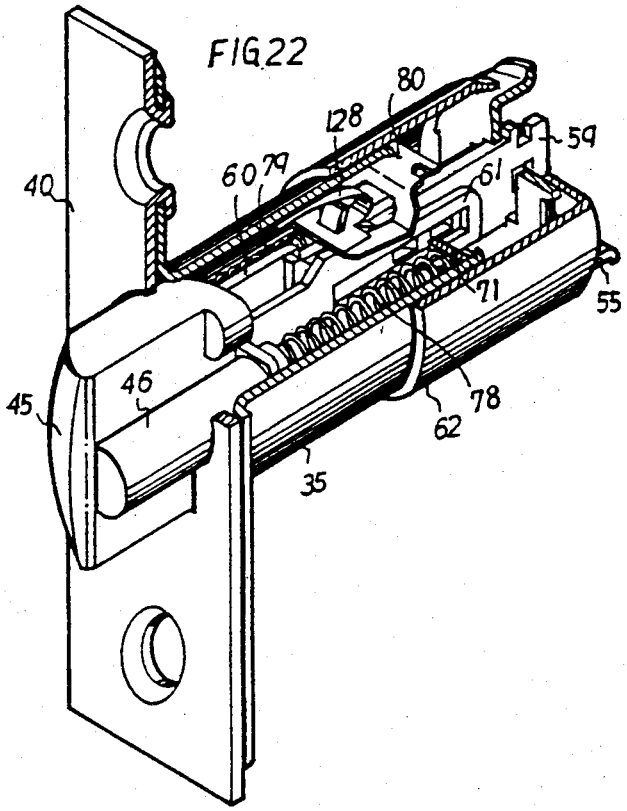

FIG. 22 is a perspective view of a partially exposed latch bolt mechanism of backset 2¾" (70 mm).

Figure 23:
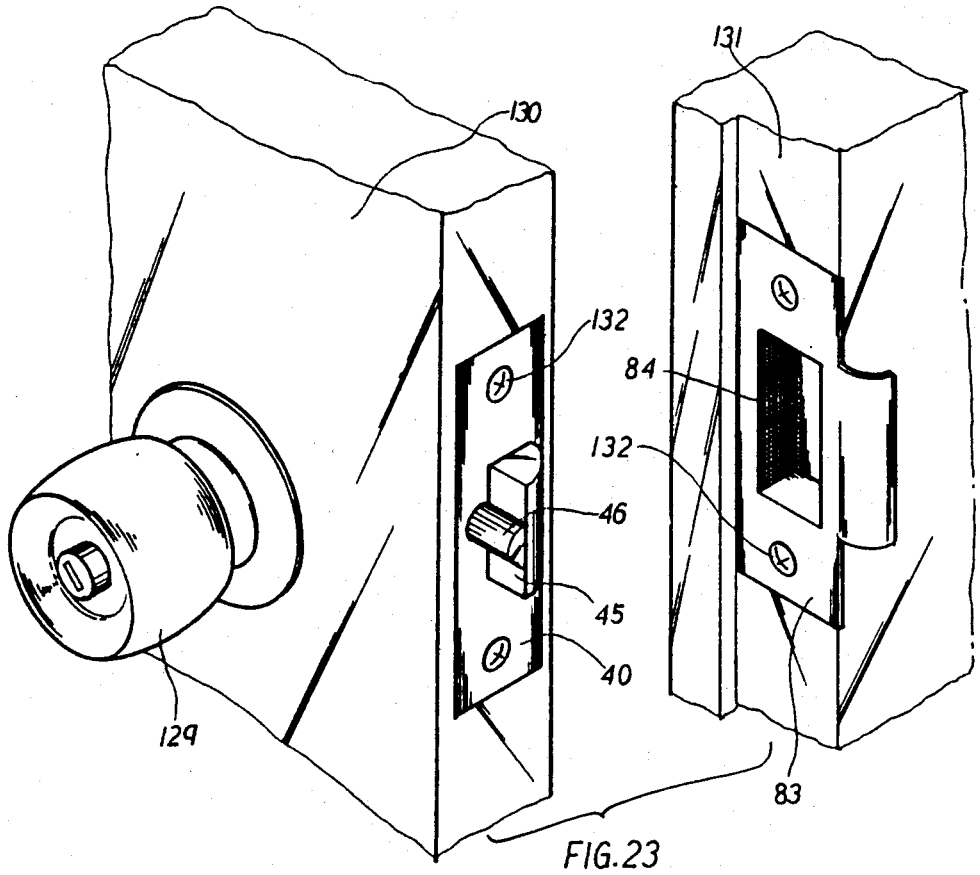

FIG. 23 is a perspective view showing the installed cylinder lock and the latch on door 130 with latch receiving hole 84 as well as the strike plate fixed by screws 132 on the door frame groove 131.

Figure 24:
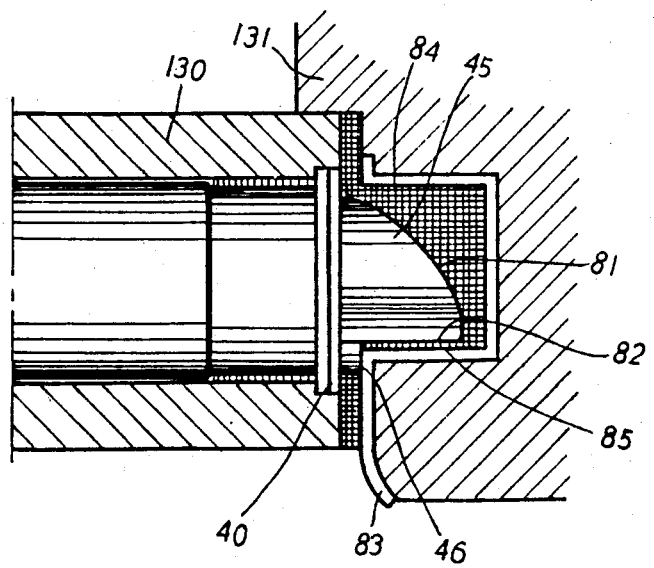

FIG. 24 is a latched sectional view of a door, which shows the latch bolt resting in the latch receiving hole and the flat side plane 82 leaning against the flat wall 85 of said receiving hole. The latch guard bolt 46 is suppressed by strike plate so that the latch bolt stopping plate prevents the latch bolt from being pushed in by force.

(2) Name of component:

35 latch bolt case
36 case front flange
37 board restricting piece
38 recess
39 screw hole
40 face plate
41 screw hole
42 circular flange
43 latch bolt passage
44 guard bolt passage
45 latch bolt
46 latch guard bolt
47 button receiving hole
48 guide ditch
49 slot
50 receiving hole bottom
51 annular inner wall
52 bottom hole
53 spiral spring
54 case fixing button
55 latch-confining board
56 board opening
57 rivet pin
58 board entended ear
59 retractor slide
60 latch bolt extension slide
61 guard bolt extension slide
62 extension case
63 guide recess
64 joint pin
65 front button bore
66 rear button bore
67 ear
68 rivet pin hole
69 cleavage
70 cylinder case
71 latch base board
72 guide cut
73 get-through cut
74 pin base hole
75 stopping plate mounting cut
76 central opening
77 spring-fixing pin
78 latch bolt retracting spring
79 guard bolt retracting spring
80 latch bolt-stopping plate
81 forward angled surface
82 latch bolt side plane
83 strike plate
84 latch bolt receiving case
85 case wall
86 latch bolt shoulders
87 inner plate face
88 latch bolt spring base
89 engaging wall
91 latch bolt inner opening
92 extension slide wedging slot
93 slide supporting arm
94 latch bolt stopping shoulder
95 guide slot
96 pin joining wall
97 cornered edge
98 connecting pin
99 connecting point
100 balance point
101 front ear
102 rear ear
103 connecting-pin hole
104 flat side
105 front latch releasing notch
106 rear latch releasing notch
107 retractor
108 front notch sloped side
109 rear notch sloped side
111 flat plane
112 bolt connecting claws
113 spring base
114 slide connecting spot
115 contact shoulder
116 ridge
117 front valley
118 rear valley
119 locking shoulder
120 slot
121 closed end
122 middle waist
123 open end
124 front side
125 inner side
126 bended piece
127 mounting cut
128 spring plate
129 doorknob
130 door
131 door frame groove
132 screw

DETAILED DESCRIPTION

Figure 1:
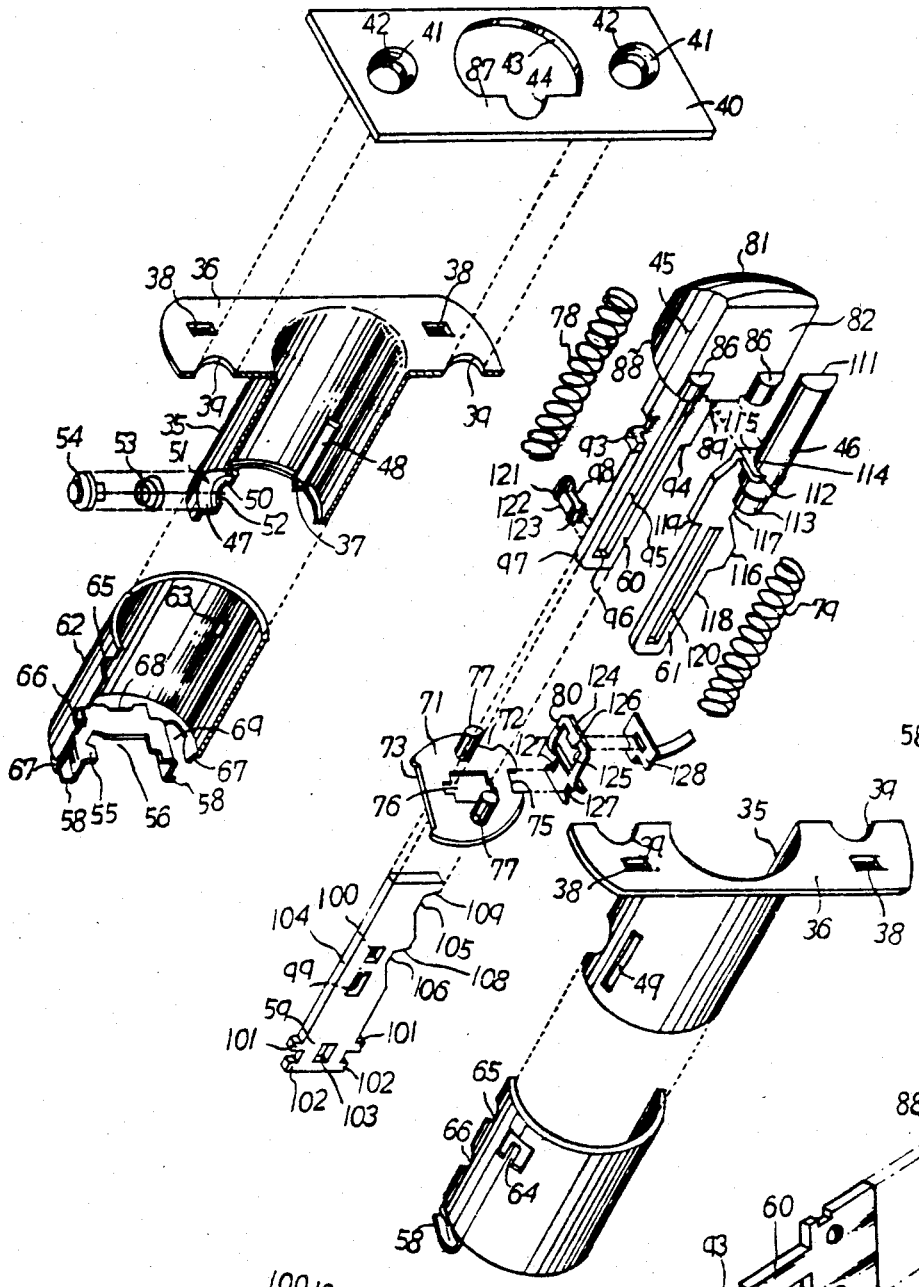
FIG. 1 is an exploded drawing of the components of the subject matter.
Figure 1:
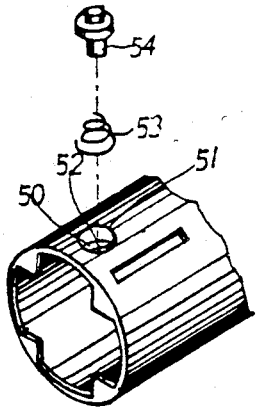
Figure 1:
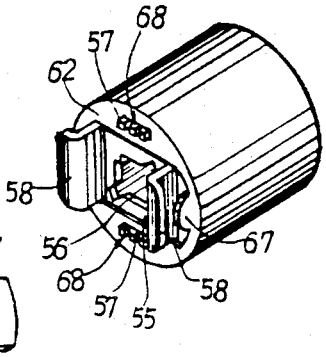
Figure 1:
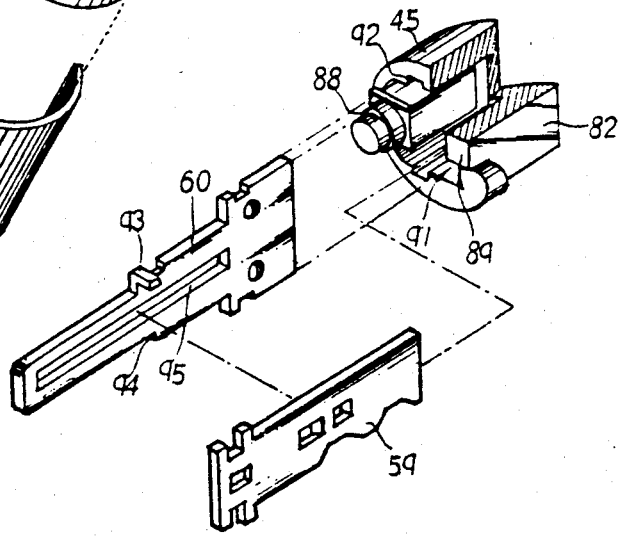
Figure 1:
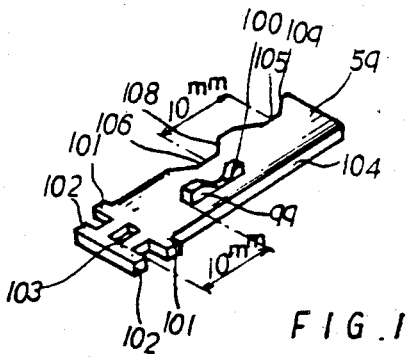

Referring to the drawings, and particularly to FIG. 1, the latch bolt mechanism of the present invention is shown as including a hollow, cylindrical latch bolt case 35 having case front flange 36 projecting therefrom, four board restricting pieces 37 at the back of the case, and four recesses 38 on the flange 36 to prevent bending of the flange in the manufacturing process. There are also two corresponding screw holes 39 for the attachment of the front face plate 40.

The face plate 40 (as shown in FIG. 1) has two screw holes 41 with protruding bottom peripheries 42 for wedging rigidly into the screw holes 39 of the case front flange 36, thus associating the face plate 40 with the latch bolt case 35. By means of two screws through the holes 41, 42, the latch bolt case together with the face plate is fixed firmly to the door. The latch bolt 45 and the guard bolt 46 are disposed through the latch bolt passage 43 and guard bolt passage 44 of the face plate 40. Within the confiners on those passages, the latch bolt and the guard bolt may protrude or retract.

Referring to FIG. 1, a cup-like button receiving hole 47 for the case fixing button 54, and a guide protrusion 48 as well as a slot 49 are also set on the wall of the case 35 near the end thereof. The receiving hole 47 has a bottom 50 with a small hole 52, and annular inner wall 51. The spiral spring 53 is based on the bottom 50, and presents a retracting force on the fixing button 54 which is firmly held in place by the bottom hole 52 and the annular inner wall 51.

A cylindrical hollow extension case 62 (referring to FIG. 1 and FIGS. 4–8) has on its wall a guide recess 63, and a joint pin 64 which can be bent into the slot 49 to join the extension case 62 and the latch bolt case 35 permanently. Front button bore 65 and the rear button bore 66 which are 10 mm apart. A pair of exented ears 67 as well as two rivet pin holes 68 are located at the rear of the oase 62. To the rear of case 62 is attached a piece of latch confining board 55 which has a central opening 56 as well as two board extended ears 58 and a pair of riveted pins 57 which are used to attach the board firmly thereto. The central opening 56 is not only for holding the retractor slide 59 but also for the passage of the reciprocating latch bolt slide 60 and the guard bolt slide 61. Rivet pins 57 as well as the ears 58 are placed through the rivet holes 68 and the opening 69 respectively. Then the latch bolt confining board 55 is riveted to the extension case 62 as shown in FIG. 1-B. The guide recess 63 engages in the guide ditch 48 to prevent the extension case from rotating when attached to latch bolt case 35. Joint pin 64 is bent into the slot 49 to permanently join the case 62 to the latch bolt case 35, as shown in FIGS. 4, 5 and 7, when the backset is permanently set.

The backset of the latch is determined when the case fixing button 54 confined in the receiving hole 47 is set into either one of the two small button bores, the front bore 65 or the rear bore 66 on the extension case 62, to set the backset $2\frac{3}{8}''$ (60 mm) or $2\frac{3}{4}''$ (70 mm) respectively as shown in FIGS. 3, 9, 10, 15 and 16. The latch bolt mechanism is connected to the cylinder case 70 of the cylinder lock by the projecting ears 67 of the extension case 62 as well as the board extended ears 58 of the latch confining board 55 which is held by the retractor 59 of the cylinder lock as shown in FIG. 4 and FIG. 5.

The latch base board 71 shown in FIG. 1 has a guide cut 72, a get-through cut 73, a pair of pin base holes 74 (not shown) a mounting cut 75 for the latch bolt stopping plate 75 and a central opening 76; the board 71 is guided into the latch bolt case 35 when the guide cut 72 engages with the protruding bottom of guide ditch 48. The board is pushed further to the bottom and is stopped by the four restricting pieces 37. The get-through cut 73 is set for letting board 71 get through the inwardly protruding spot of the bottom receiving hole 47 on the wall of latch bolt case 35. Two spring-fixing pins 77 rooted on the board 71 as shown in FIG. 14 and are for the installation of latch bolt retracting spring 78 as well as guard bolt retracting spring 79.

Referring to FIGS. 1, 9 and 10, the latch bolt stopping plate 80 firmly mounts on the latch base board 71 by means of the mounting cut 75, and the central opening 76 through which latch bolt extension slide 60, retractor slide 59 and guard bolt extension slide 61 are disposed for maintaining their associated positions and their directions of motion.

The previously mentioned latch bolt 45 (as shown in FIGS. 1 and 24) is shaped to have a forward angled surface 81 and a flat side plane 82 for easy sliding into the latch bolt receiving case 84. When the door is shut, the latch bolt 45 hits the strike plate 83 first, then the latch bolt pressed against the strike plate is released to its natural postion after it slides into the case 84 with its flat side plane 82 in intimate contact with the wall 85 of the case 84. There are two shoulders 86 set on the flat latch bolt side plane 82 near the bottom for enabling the bolt to push against the inner face 87 of the face plate 40 after the latch bolt sticks out through the latch bolt passage 43.

A spring base 88 as well as an engaging wall 89, which is for reception of the shoulder 115 of the guard bolt extension slide 61 (shown in FIG. 1-C), is set at the rear of the latch bolt 45. The base 88 is disposed in line with the spring fixing pin 77. A retracting spring by which the latch bolt is capable of protruding and stretching is located therebetween as shown in FIGS. 9 and 10.

For allowing the retractor slide to have a relatively forward movement, inside the latch bolt 45, there exists rectangular inner opening 91 as shown in FIG. 1-C for receiving the front of the retractor slide when the latch bolt 45 is pushed backward. Just next to the retractor slide is wedged rigidly the front portion of the latch bolt extension slide 60, within the opening of the bolt 45 as shown in FIGS. 9 and 10.

Latch bolt extension slide 60 is placed in juxtaposition to the retractor slide 59 (see FIGS. 1, 7, 9, 10, 15 and 16) and has a slide supporting arm 93, a stopping shoulder 94 for engaging with the latch bolt stopping plate 80, a flute 95 having a pin joining wall 96 and cornered edge 97 at the end thereof. The supporting arm 93 serves to keep the retractor slide 59 steady on its track during its longitudinal movement.

Connecting pin 98 or connecting point 99 of the retractor slide 59 is permitted to move longitudinally along the flute 95; also the balance point 100 moves therein. The cornered edge 97 at the end of the latch bolt extension slide is adapted for easy passage through the central opening 56 of the latch confining board 55 when the backset of the latch is set $2\frac{3}{4}''$ (70 mm) as shown in FIG. 20. The detailed description of the operation is presented in the following specification.

The retractor slide 59 is placed between the latch bolt extension slide 60 and the guard bolt extension slide 61 as shown in FIGS. 1, 9, 10, 15, 16, 21 and 22, and is located in the middle of the latch bolt case 35, in juxtaposition to the slide 60 and slide 61. Retractor slide 59 extends through the central opening 76 and is held on the latch confining board 55 of the extension case. Retractor slide 59 has a pair of front ears 101, a pair of rear ears 102, a balance point 100, a connecting point 99, a connecting pin hole 103, a flat side 104 as well as an opposing side having front latch releasing notch 105 and a rear latch releasing notch 106. The connecting point 99 and the connecting pin hole 103 are located 10 mm apart. The front releasing notch 105 and the rear releasing notch 106 are also set 10 mm apart. The front ear 101 is disposed against the back of the latch confining board 55 so that the retractor slide 59, the extension case 62 and the latch confining board 55 form a retractable mechanism at the back of the latch bolt case as shown in FIGS. 15, and 16. The rear ears 102 shown in FIGS. 4 and 5 are in engagement with retractor 107 for translating a turning movement of the doorknob into a longitudinal movement of the retractor slide. Referring to FIGS. 9, 10, 15 and 16, the balance point 100, movable in the flute 95, is used to keep retractor slide 59 on its track without losing balance, as shown in FIGS. 16 and 20. The sloped side 108 of the rear releasing notch 106 released the blocked latch bolt when the backset set at 2⅜" (60 mm); the sloped side 109 of the front releasing notch 105 as shown in FIGS. 17 and 19 releases the blocked latch bolt when the backset is set at 2¾" (70 mm). With the supporting arm 93 of the latch bolt extension slide holding the flat side 104 of the retractor slide 59, the slide 59 is kept in place in its longitudinally movement as shown in FIGS. 11–14, FIGS. 17–20. On the other hand, the supporting arm 93 of the latch bolt extension slide 60 also serves to restrain the retractor slide from losing its balance owing to the lateral pushing of the latch stopping board 80 when the front side 124 of the board 80 is being pushed up by the sloped side 108 or 109 in the latch bolt releasing process thus guaranteeing smooth and precise operational action.

Referring to FIGS. 1, 9 and 10, the connecting pin 98 is inserted into the pin hole 103 in order to set the latch backset at 2 2/8" (60 mm). On the other hand the connecting point 99 replaces the function of the connecting pin 98 when the backset is set at 2¾" (70 mm) as shown in FIGS. 1-D, 15 and 16. In the first case, the connecting pin 98 is disposed in the pin hole 103 of the retractor slide 59 with the front ears 101 leaning against the back of the latch confining board 55 and the fixing button 54 in the rear button bore 66 of the extension case as shown in FIGS. 4, 6, 9, and 10. At the rear ears 102 of retractor slide being pulled backward by the retractor 107, the sloped side 108 (see FIG. 11) lifts up the latch bolt stopping plate 80 so to let go of the latch bolt, and by means of the connecting pin 98 (see FIGS. 13, 14) engaging with the pin journal wall 96 of the extension slide, the latch bolt mechanism is pulled backward into a withdrawing state. By removing the connecting pin 98 and pressing down the fixing button 54 into the button hole 66 and pulling the extension case backward with the fixing button 54 popping into the front button bore 65, which is 10 mm apart from the rear button bore 66, the latch mechanism is then transformed into one of backset 2¾" (70 mm). Meanwhile, the retractor slide 59 associated with the latch stopping board moves 10 mm backward with the connecting point 99 which serves like the connecting pin 98 under this circumstance, and the front releasing notch 105 moves to the very position that releasing notch 106 had before and replaces its function. In the same way, the front latch releasing notch 105 (see FIG. 17) releases the latch bolt by its sloped side 109 as soon as the rear ears 102 of the retractor slide is pulled backward by the retractor 107, in the meantime the connecting point 99 (see FIG. 20) engaging with the pin joining wall 96 of the latch bolt extension slide 60 transmits the pulling movement to the latch bolt mechanism and brings it into a retracted state.

Referring to FIGS. 1, 9 and 10, the latch guard bolt 46 of the latch guarding mechanism has a flat plane 111, having the shape of a longitudinal cut of the cylindrical guard bolt, leaning against the flat side plane 82 of the latch bolt, a bolt-connecting claws 112, a cylindrical spring base 113 at the end of the bolt in line with the spring-fixing pin 77 attached to the latch base board 71, the guard bolt retracting spring 79 located therebetween, and a slide connecting spot 114, and a contact shoulder 115 set against the back of latch bolt. On the bottom side of the guard bolt extension slide, a ridge 116 rises between the front valley 117 and rear valley 118, a locking shoulder 119 on the top side, and a flute 120 in the middle of the slide.

When the latch bolt mechanism is in extended state, the latch guard bolt, supported by the stretched retracting spring 79, with its shoulder 115 against the back of the latch bolt, sticks out through the bolt passage 44 of the face plate 40 with its flat plane 111 flush against the flat side plane 82 of the latch bolt.

When the latch bolt is in a retracted state, as shown in FIGS. 11, 12, and 24, the shoulder 119 on the guard bolt extension slide is blocked by the face of the latch base board 71 so to assure that the latch guard bolt 46 will not be pried loose into the latch bolt case 35 and loses its guarding ability.

The above connecting pin 98 (see FIGS. 1, 4, 6, 9, and 10) is made of steel material and shaped like an open pin having an arc end 121, a middle waist 122 and an open end 123. The resilient open end 123 is pressed together and inserted through the end of the flute 95 of the extension slide 60 and further into the connecting pin hole 103 and through the flute 120 of the guard bolt extension slide 61 with the arc end 121 resting in the flute 95, the waist 122 dwelling in the pin hole 103 and the open end 123 leaning against the end of the flute 120. In such an arrangement the latch bolt mechanism and the retractor slide 59 can be united as one with the backset set at 2⅜" (60 mm). Upon the retractor slide 59 being pulled backward, the arc end 121 of the connecting pin dwelling against the pin joining wall 96 can transmit the pulling movement to the latch bolt mechanism causing it to retract with the said slide.

As shown in FIG. 1, the latch bolt stopping plate 80 mounting on the latch base board by engaging the mounting cut 127 with the stopping plate fixing cut 75. Latch bolt stopping plate 80 has a front side 124, an inner side 125, a bent piece 126, and a pair of mounting cuts 127 at the other end. The front side 124 (see FIGS. 11 and 17) being positioned in front of the latch bolt stopping shoulder 94 blocks latch bolt 45 from moving back and prevents the latch bolt from being pried open by force.

The spring plate 128 (see FIG. 21) having a long hook-like piece which is disposed against the inner wall of the latch bolt case 35 with its base detachably mounted on the bent piece 126 of the latch stopping plate 80, exerts a force on the latch stopping plate to effect its required operational action.

The present invention, consisting of the above described components and able to carry out the three required functions is adapted to be transformable from a latch of backset $2\frac{3}{8}''$ (60 mm) into one of backset $2\frac{3}{4}''$ (70 mm). To transform a latch of backset $2\frac{3}{8}''$ (60 mm) (see FIGS. 3, 4, 6, 9, 10 and 21) to one of backset $2\frac{3}{4}''$ (70 mm) (see FIGS. 3, 5, 8, 15, 16 and 22), it is only necessary to take away the connecting pin 98 as, shown in FIGS. 3, 9 and 15, push down the fixing button 54 resting in the button bore 66 and pull out the extension case 62 until button 54 pops out in the other button bore 65.

The effect and operation of the latch mechanism of two different backset $2\frac{3}{8}''$ (60 mm) and $2\frac{3}{4}''$ (70 mm) will now be briefly reviewed:

1. The operation of the latch mechanism of backset $2\frac{3}{8}''$ (60 mm):

(1) When the door is open as shown in FIGS. 9, 10, 21 and 23, the latch bolt mechanism as well as the latch guard bolt is in neutral state with the ridge 116 of the guard bolt extension slide supporting the front latch bolt stopping plate 80 so to permit the latch bolt mechanism and latch guard bolt to retract.

(2) When the door is shut as shown in FIGS. 11, 12 and 24, the latch bolt mechanism remains extended with the latch bolt 45 resting in the bolt receiving case 84 through face plate 40 and the latch guard bolt 46 is suppressed by the strike plate 83; the guard bolt 46 as well as the attached extension slide 61 is pushed into the latch bolt case 35. As a result, the front side 124 of the latch bolt stopping plate 80 slips off the ridge 116 and into the front valley 117 to press against the shoulder 94 of the latch bolt extension slide so to block the latch bolt from being pried open.

Figure 2:
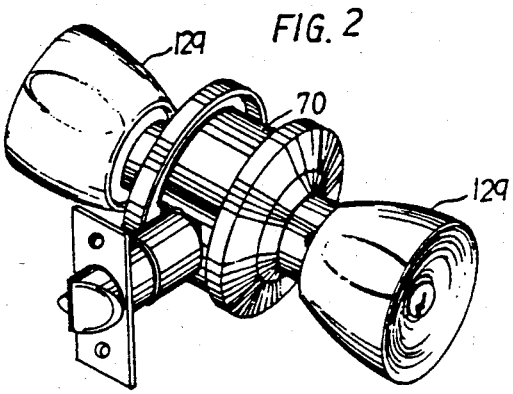
FIG. 2 is a perspective view of the assembled set of cylinder lock showing the relevant positions of the doorknob 129, cylinder case 70 as well as the latch bolt mechanism.

(3) When the door is being unlocked as shown in FIGS. 11, 12, 13 and 14, the doorknob 129 of the cylinder lock (see FIG. 2) is turned to make the released retractor 107, (see FIG. 4) which holds the rear ears 102 of the retractor slide joined as one therewith the latch bolt and the guard bolt extension, connected to the latch bolt by connecting pin 98 which is disposed against the pin joining wall 96, retract backward. In, the meantime, the sloped side 108 of the rear releasing notch 106 acts lifts the front side 124 of the stopping plate 80 smoothly as shown in FIGS. 11 and 12, allowing the latch bolt to retract.

2. The operation of the latch bolt mechanism of backset $2\frac{3}{4}''$ (70 mm):

(1) The disposition of the latch mechanism is the same as that of backset 60 mm as shown in FIGS. 15, 16, 22 and 23 when the door is not shut.

(2) When the door is closed, the disposition of the latch mechanism is similar to that of backset 60 mm.

(3) When the door is being unlocked (see FIGS. 17, 18, 19 and 20), the doorknob 129 of the cylinder lock (see FIG. 2) is turned to make the mechanically connected retractor 107 (see FIG. 5), which holds the rear ears 102 of the retractor slide, with connecting point 99 (see FIGS. 18 and 20) disposed against the pin joining wall 96 of the extension slide 60, withdraw together with the latch bolt mechanism. In the meantime the sloped side 109 of the front releasing notch 105 (see FIG. 17) smoothly lifts the front side 124 of the stopping plate 80 as shown in FIGS. 19 and 20, allowing the previously blocked latch bolt to retract.

What I claim is:

1. A backset-adjustable latch bolt mechanism for a cylinder lock, comprising:

a latch bolt case having a flanged front defining an opening therein, said latch bolt case housing:

a latch bolt means including a latch bolt, said latch bolt being biased in a protruding position to protrude forward out of said housing through said opening and being rearwardly retractable into a retracted position through said opening into said case housing, and a laterally slotted latch bolt extension slide, joined, at a forward end thereof, to a rearward end of said latch bolt, a latch bolt guard means for limiting rearward movement of said latch bolt into said case housing when said latch bolt is in said protruding position, including a retractable guard bolt positioned flush against a lateral face of said latch bolt, a laterally slotted guard bolt extension slide connected at a forward end thereof to a rearward end of said guard bolt, said guard bolt extension slide having an arm depending therefrom, and a stopping plate movable in and out of a retracting path followed by said latch bolt extension slide when said latch bolt is moved from said protruding position to said retracted position, said arm causing said stopping plate to block said retracting path when said latch bolt guard is in a retracted position while said latch bolt is in said protruding position;

a slotted retractor slide;

a latch base board, having a bore therein through which extend said latch bolt extension slide, said guard bolt extension slide, and said retractor slide;

a latch confining board, fixed to a rear end of said casing, having a bore in which a rearward end of said retractor slide is fixed;

said retractor slide having a protrusion for slidably extending through said slot of said lock bolt extension slide, means defining a hole, positioned a lateral distance from said protrusion equal to a desired backset adjustment, for receiving a removable connecting pin capable of slidably fitting through and connecting the slots of said latch bolt extension slide, said retractor slide, and said guard bolt extension slide, a first nose portion having a first valley for resting said latch base board therein and a second nose portion having a second valley for resting said latch base board therein, said first and second valleys being spaced said longitudinal distance apart;

said casing having a front section and a rear section coaxial and slidable relative to each other, one of said front section and said rear section being an inner section, the other section being an outer section, a depressable button extending radially outward from said inner section, said outer section having a means defining a first hole and a means defining a second hole on said outer section, said first and second holes being spaced said longitudinal distance from each other, for receiving said button;

whereby, when said button is depressed into one of said holes, said removable pin has been removed, and said latch board is resting in one of said valleys, said case sections may be slid apart to cause said respective nose portion of said retractor slide to slide upon said latch base board; lifting said retractor slide until said latch base board is set with said other valley and said button has been received in said other hole, thus adjusting the backset of said latch bolt mechanism.

2. The latch bolt mechanism of claim 1, wherein said protrusion on said retractor slide is positioned rearward of said hole for receiving said connecting pin, and said first nose portion and button receiving first valley are positioned rearward of said second valley, said second nose portion and second button receiving hole, respectively, said forward section is said inner section, and said connecting pin is fitted through said slots of said retractor slide, said latch bolt extension slide, and said guard bolt slide when said backset is set so that said button is in said second button receiving hole.

3. A latch bolt mechanism as defined in claim 2, wherein said case housing has, in one section, an inwardly recessed guide ditch as well as a slot disposed in said forward section.

4. A latch bolt mechanism as defined in claim 3, wherein each said button receiving hole is a recessed hole with a circular wall and a bottom having a round bore at the center.

5. A latch bolt mechanism as defined in claim 3, wherein said recessed guide ditch has one end thereof starting from an edge of said latch bolt case.

6. A latch bolt mechanism as defined in claim 3, wherein a rectangular slot is disposed on said inner section of said latch bolt case.

7. A latch bolt mechanism as claimed in claim 3, wherein said latch-confining board is secured to the rearward end of said rear section by two rivets.

8. A latch bolt mechanism as claimed in claim 7, wherein said rear section has a radially inward extending joint pin for bending in a slot on said forward section to permanently attach the extension case to said latch bolt case and an inwardly recessed point on said rearward section is slidably located in said guide ditch to prevent said extension case form rotating about said latch bolt case.

9. A latch bolt mechanism as claimed in claim 7, wherein said latch confining board having said bore therein is for the passage of said retractor slide and said latch bolt extension slide as well as said guard bolt extension slide and said latch confining board has two radially extended ears slightly bent at their free ends and projecting in opposite radial directions.

10. A latch bolt mechanism as claimed in claim 2, wherein said rearward end of said latch bolt has a rectangular opening for receiving a front end of said retractor slide as the said latch bolt is retracted, and said forward end of said latch bolt extension slide being wedged rigidly in a rearward end of said latch bolt.

11. A latch bolt mechanism as claimed in claim 10, wherein said latch bolt extension slide has a bent supporting arm on one side thereof for stabilizing said retractor slide, and an opposing side of said latch bolt extension slide has a raised shoulder, the rearward end of said latch bolt extension slide being smoothly cornered.

12. A latch bolt mechanism as claimed in claim 2, wherein the first button receiving hole is for receiving said button when the backset is set at $2\frac{3}{8}''$ (60 mm), and the second button receiving hole is for receiving said button when the backset is set at $2\frac{3}{4}''$ (70 mm).

13. A latch bolt mechanism as claimed in claim 2, wherein said guard bolt extension has two flat sides joined by top and bottom edges and on the top edge of said guard bolt extension slide is a flat-top ridge.

14. A latch bolt mechanism as claimed in claim 2, wherein said latch bolt stopping plate and said latch bolt stopping plate are mounted removably and firmly on said latch confining board, and a spring plate is mounted on said stopping plate for exerting constant force on said stopping plate.

15. A latch bolt mechanism as claimed in claim 14, wherein said latch-confining board has two spring fixing pins extending forward therefrom, and a peripherally located guide cut engaged with said protruding guide ditch in said forward section to prevent said latch confining board from moving, a get-through cut located on a periphery thereof for permitting said board to be slipped past an inward protrusion where said protrudent button is mounted on said latch bolt case during installation, and a stopping plate mounting cut on an opposing periphery for mounting of said latch bolt stopping plate, and two round holes from which said spring fixing pins extend.

16. A latch bolt mechanism as claimed in claim 1, comprising a hollow cylindrical case which has a flat flange at the front end with four protrudent spots and two screw holes on it, secured to said face plate by riveting as one thereto and has four bended board restricting pieces at the rear end of the case for restricting said latch base board.

17. A latch bit mechanism as claimed in claim 1, wherein said button is outwardly biased by a spiral spring.

18. A latch bolt mechanism as claimed in claim 17, wherein said button which is shaped as a round pin fixed to a coaxial circular disk.

19. A latch bolt mechanism as claimed in claim 1, wherein said connecting pin has a closed end, a middle waist, and an open end, and is removably joined as one with said retractor slide to transmit a pulling movement of said retractor slide to said latch bolt extension slide to retract the latch bolt mechanism when the backset is set at $2\frac{3}{8}''$ (60 mm).

* * * * *